US007077541B1

(12) United States Patent
Prioa

(10) Patent No.: US 7,077,541 B1
(45) Date of Patent: Jul. 18, 2006

(54) SAFETY FLASHLIGHT HOLDER

(76) Inventor: Nicholas Prioa, 89 N. Main St., Poland, OH (US) 44514

( * ) Notice: Subject to any disclaimer, the term of this patent is extended or adjusted under 35 U.S.C. 154(b) by 78 days.

(21) Appl. No.: 10/936,402

(22) Filed: Sep. 9, 2004

(51) Int. Cl.
*F21L 4/00* (2006.01)

(52) U.S. Cl. ..... 362/190; 362/202; 362/84

(58) Field of Classification Search ..... 362/190, 362/191, 202, 84; 206/573; 248/183, 309.1, 248/313, 316.1
See application file for complete search history.

(56) References Cited

U.S. PATENT DOCUMENTS 3,713,614 A 1/1973 Taylor
4,220,304 A 9/1980 Wong et al.
4,750,095 A 6/1988 Huang
4,938,440 A * 7/1990 Weinfield ..... 248/183.1
5,413,223 A * 5/1995 Kang ..... 206/573
6,033,080 A 3/2000 Hasegawa et al.
6,039,297 A 3/2000 Johnson
6,485,159 B1 * 11/2002 Pitts ..... 362/84

* cited by examiner

*Primary Examiner*—Ali Alavi
(74) *Attorney, Agent, or Firm*—Harpman & Harpman

(57) ABSTRACT

A flashlight holder and safety illumination indicator locator for selectively holding a flashlight with a visual guidance element integrated within. The safety flashlight holder includes a one-piece housing having a resilient flashlight body engagement bracket with independent gripping arms and a vertically spaced flashlight end engagement cup extending from the housing. A luminescent insert disk defines the visual locator providing safety access to the flashlight and orientation of the flashlight holder there within.

12 Claims, 3 Drawing Sheets

SAFETY FLASHLIGHT HOLDER

BACKGROUND OF THE INVENTION

1. Technical Field

This invention relates to flashlight holders that are used to temporarily hold and store flashlights for ease of use. Specifically, this invention is directed to self-illuminating safety flashlight holders that utilize a form of photo-luminescent material that have light storing and emitting properties after initial exposure to light energy in combination.

2. Description of Prior Art

Prior art devices of this type have relied on a wide variety of designs to engage and hold flashlights, see for example U.S. Pat. Nos. 3,713,614, 4,220,304, 4,750,095, 6,033,080 and 6,039,297.

In U.S. Pat. No. 3,713,614 a flashlight holder is disclosed that uses a magnetic engagement and retainment bracket extending from the body of the flashlight for magnetic registration with a corresponding receiving plate attached to a mounting wall surface.

U.S. Pat. No. 4,750,095 shows an auto lighting flashlight assembly and holder wherein a bracket is provided to selectively engage and hold a flashlight. A battery disconnect rod extends from the bracket and registerably engages through an opening in the special flashlight to mechanically separate the batteries when positioned within the holder to prevent discharge.

In U.S. Pat. No. 6,033,080 an emergency light is disclosed utilizing chemiluminescent light sticks within a hinged wall holder.

U.S. Pat. No. 6,039,297 claims a handy flashlight holder wherein a cylindrical casing is secured to a wall surface or the like. The casing has select portions cut-away for access to the activation switch of a flashlight positioned within. A transverse support rod extends through on end of the cylinder defining an internal support element for the flashlight to rest when positioned therein.

Other prior art devices are well known within the art in which a flashlight can be mechanically engaged and held in a bracket for temporary storage and use.

SUMMARY OF THE INVENTION

An integral safety flashlight holder and locator device for temporarily retaining a flashlight in a prescribed location for ease of location and use. The safety flashlight holder and locator utilizes a one-piece design incorporating integral opposing resilient engagement armatures and open retainment enclosure support into which a corresponding flashlight is selectively positioned and retained. A luminescent safety locator disk indicates location of the holder and orientation of the flashlight removably held within for retrieval.

DESCRIPTION OF THE PREFERRED EMBODIMENT

Figure 1:
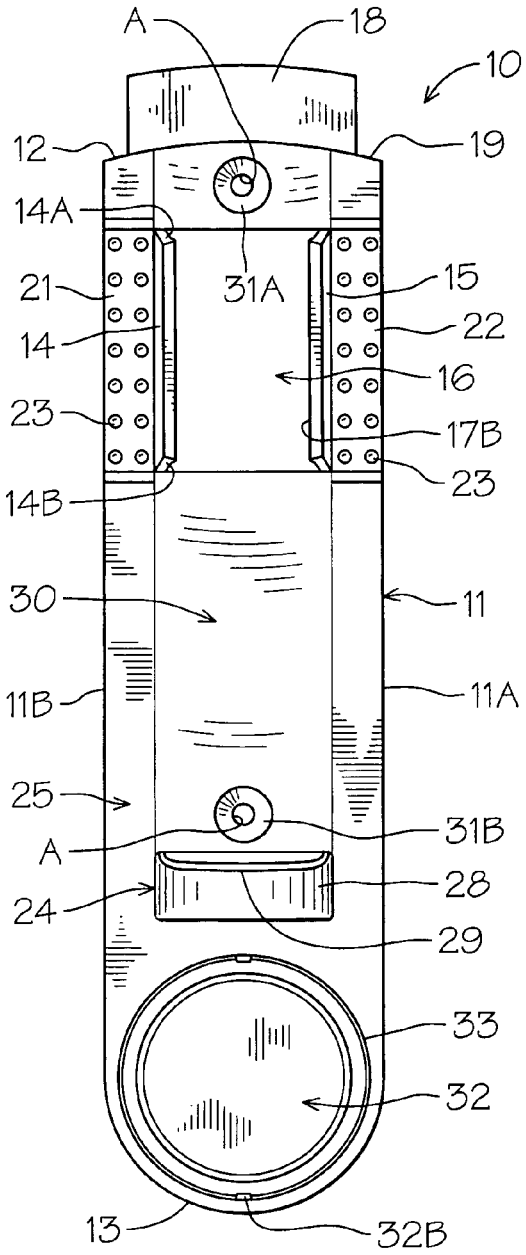
FIG. 1 is a front elevational view of the flashlight holder locator of the invention.
Figure 2:
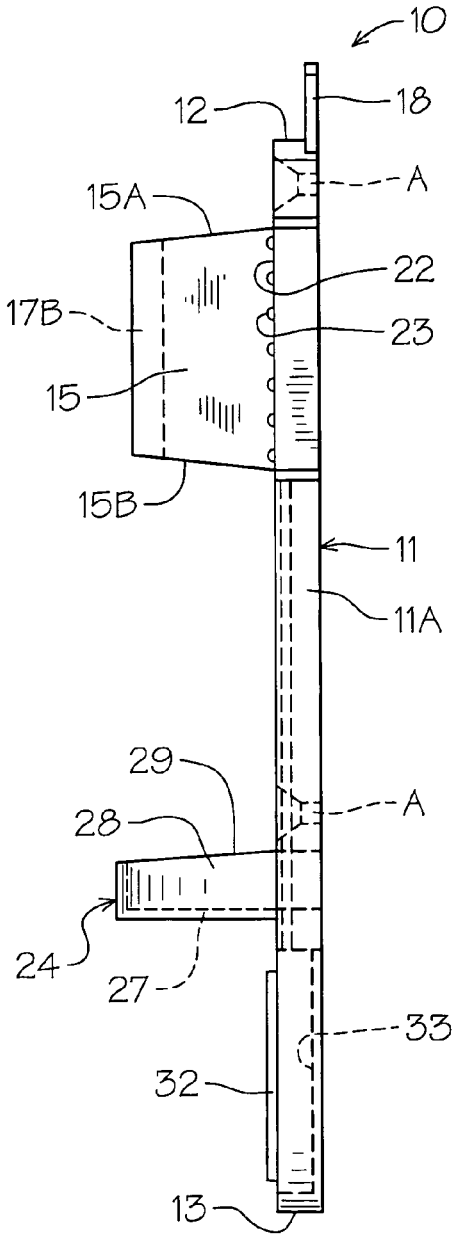
FIG. 2 is a side elevational view thereof.

Referring to FIGS. 1 and 2 of the drawings, a safety flashlight holder and locator 10 can be seen having a main elongated body member 11 with oppositely disposed upper and lower ends 12 and 13 respectively defining a generally rectangular configuration. A pair of oppositely disposed resilient engagement arms 14 and 15 extend from the body member 11 inwardly from the upper end 12. The engagement arms 14 and 15 are each of a rectangular configuration extending longitudinally from the surface 25 of the body member 11 on each side of an opening at 16 defined therebetween. The engagement arms 14 and 15 have tapered ends 14A, 14B, 15A and 15B. The arms 14 and 15 are of uniform thickness from the body member 11 with respective elongated longitudinally integral retainment lug portions 17A and 17B thereon. The retainment lug portions 17A and 17B will impart resilient deflection to the arms during use as will be described in detail hereinafter.

An orientation flange 18 extends integrally from an arcuate edge surface 19 of the upper end 12 and has a corresponding arcuate perimeter edge surface as best seen in FIG. 1 of the drawings.

The resilient retainment arms 14 and 15 are set inwardly of longitudinal edges 11A and 11B of the body member 11 defining respective adjacent textured areas 21 and 22 each with a plurality of aligned spaced protrusions 23 oriented in pairs thereon.

A flashlight receiving cup 24 extends integrally at right angles from the surface 25 of the main body member 11 and is in longitudinal spaced relation to said retainment arms 14 and 15. The flashlight end receiving and support cup 24 defines a secondary opening in the main body member 11 at 26 with a base 27 having an integral upstanding continuous curvilinear wall 28 thereabout adjoining the main body member 11. A free edge at 29 of the wall 28 is angularly disposed from the surface 25 as best seen in FIG. 2 of the drawings.

Figure 3:
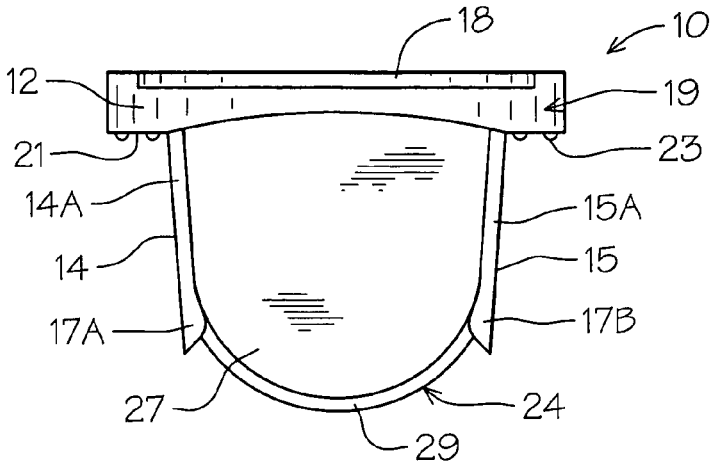
FIG. 3 is an enlarged top plan view thereof.
Figure 4:
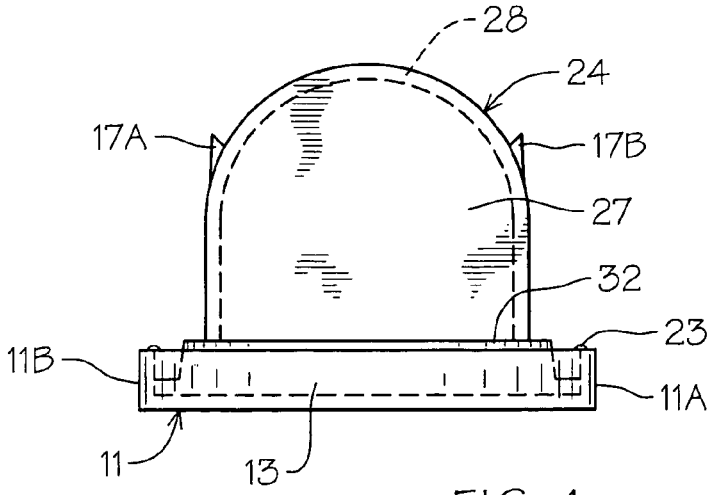
FIG. 4 is an enlarged bottom plan thereof.

It will be noted that the main body member 11's surface 25 has an elongated portion at 30 which is transversely arcuately recessed in a concave fashion as illustrated in FIGS. 1 and 3 of the drawings and has a pair of mounting apertures A in respective annular concaved recesses 31A and 31B therein.

A luminescent element 32 is secured within an annular recess 33 in the main body member 11 extending from and conforming with the lower end 13 thereof. The annular recess at 33 extends across the main body member 11 adjacent the hereinbefore described receiving and support cup 24 as best seen in FIG. 1 of the drawings.

The annular recess 33 has a pair of retainment tabs 32A and 32B for registration with the luminescent element 31 which accordingly has, in this example chosen for illustration, an annular flange at 32C thereabout.

It will be evident from the above description that the luminescent element 32 with its annular flange 32C is inserted into the recess 33 and resiliently engages and is retained under the respective tabs 32A and 32B.

The luminescent element 32 is preferably formed from a synthetic resin based material having enhanced luminescent properties that provides a prolonged afterglow of visible light after being exposed to light as is well known and available within the art.

Figure 5:
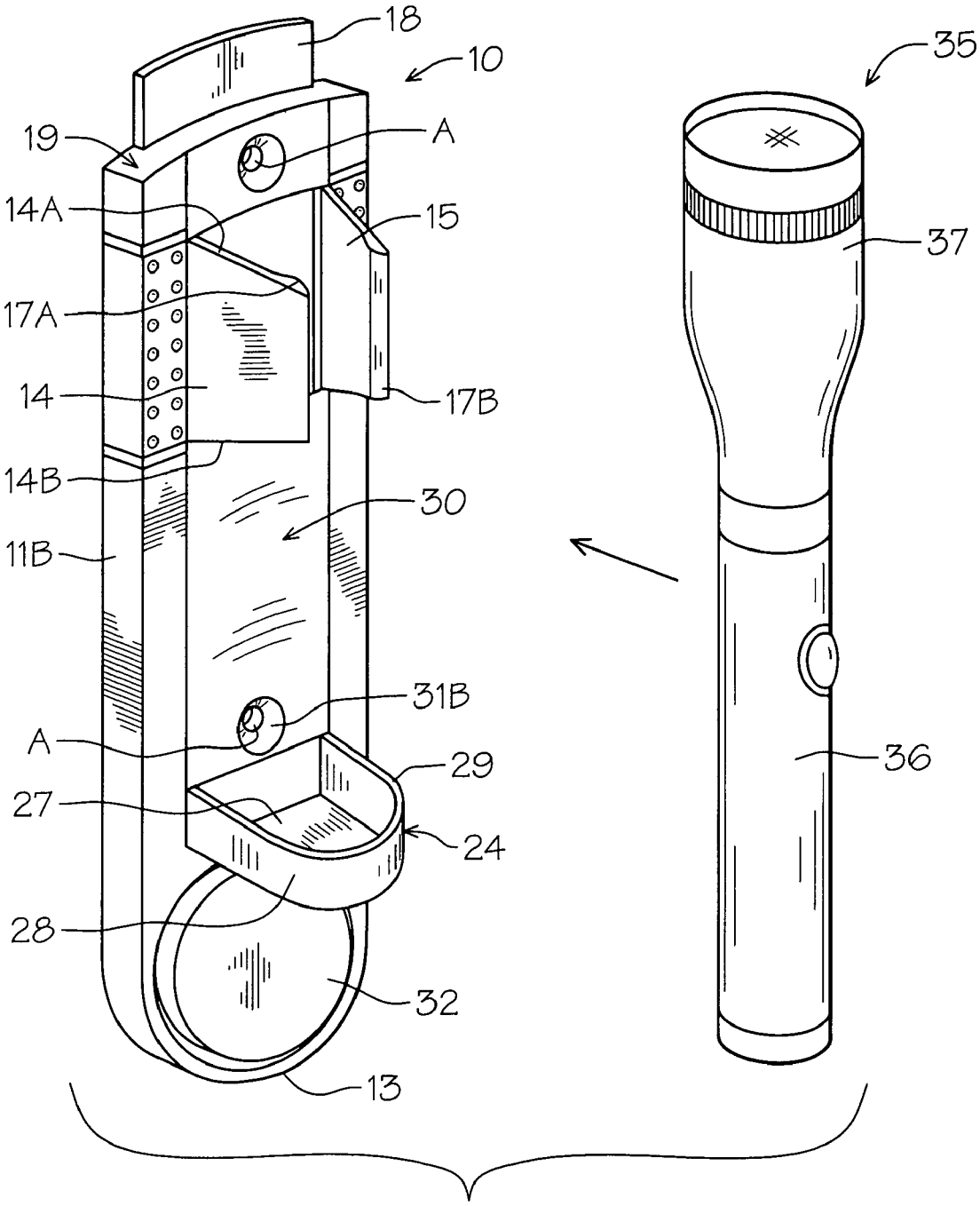
FIG. 5 is a perspective view of the flashlight holder locator assembly with a flashlight to be positioned within.

Referring now to FIG. 5 of the drawings, the safety flashlight holder and locator 10 of the invention can be seen in an assembly with a flashlight 35 positioned in spaced relation thereto for insertion within.

It will be evident that the flashlight 35 has a battery containment barrel 36 and an integral enlarged illuminating head portion 37 and is of a physical dimension that the end of the barrel portion 36 will fit within the flashlight end receiving and support cup 24 and then registerably engaged between the resilient arms 14 and 15 which will resiliently yield and then return to securely hold the flashlight 35 longitudinally upright within the flashlight holder 10 of the invention assisted by the previously described recess portion 30 on the surface 25 of the main body member 11.

The positioning of the annular luminescent element 32 within the corresponding recess 33 at the lower end at 13 thereof will provide a directional locator for the user (not shown) in the dark as well as act as a flashlight orientation device indicating that the flashlight 35 is in vertically aligned position within the holder for safe and quick removal and use as is required.

It will be evident that the safety flashlight holder and locator 10 of the invention is preferably molded of synthetic resin material in an integral one-piece configuration with the enhanced luminescent element 32 inserted within as hereinbefore described.

It will thus be seen that a new and novel safety flashlight holder and locator has been illustrated and described and it will be apparent to those skilled in the art that various changes and modifications may be made therein without departing from the spirit of the invention.

Therefore I claim:

1. A safety flashlight holder and locator for a flashlight comprising a main elongated body member, said body member having oppositely disposed sides and respective upper and lower ends, opposing upstanding spaced engagement arms in spaced relation to said upper end, an opening defined between said engagement arms in said main body member, a flashlight and receiving cup extending from said body member in longitudinal spaced relation to said lower end thereof, a luminescent disk recessed within said main body member inwardly from said lower end, means for resiliently retaining flashlight between said engagement arms, means for alignment location of the flashlight within said flashlight holder, and means for securing said flashlight holder to a wall surface.

2. The emergency flashlight locator holder set forth in claim 1 wherein said flashlight and receiving cup has an upstanding continuous arcuate sidewall extending from said main body member on either side of an opening therein.

3. The emergency flashlight locator holder set forth in claim 1 wherein said means for resiliently retaining the flashlight between said retaining arms comprises, elongated lugs on ends of said arms, said lugs defining tapered engagement surfaces, an elongated concave surface portion on said surface of said main body member between said engagement arms and said flashlight receiving cup.

4. The safety flashlight holder and locator set forth in claim 1 wherein said means for alignment location of the flashlight within said holder comprises, an annular recess in said main body member inwardly of said lower end thereof.

5. The safety flashlight holder and locator set forth in claim 1 wherein said means for securing said flashlight holder and locator comprises, longitudinally spaced mounting apertures in said main body member.

6. The safety flashlight holder and locator set forth in claim 1 wherein said main body member's upper and lower ends are arcuate and an extension orientation flange extends from said upper arcuate end thereof.

7. The safety flashlight holder and locator set forth in claim 1 wherein said luminescent disk is of a synthetic resin material of enhanced luminescent retainment properties.

8. The combination of a flashlight and a flashlight holder and locator comprising, a flashlight having a cylindrical battery retaining barrel and enlarged end lens portion, a flashlight holder and locator comprising, a main elongated body member, oppositely disposed elongated resilient engagement arms extending therefrom, an opening in said body member between said arms, a flashlight and receiving cup in spaced vertical alignment with said engagement arms, an opening in said main body member within said support cup, a luminescent disk recessed within said body member inwardly from one end thereof, a flashlight receiving portion on the surface of said main body member between said arms and said receiving cup and extending therebeyond to said upper remaining end of said flashlight receiving portion defining a transverse concave surface therein, means for securing said flashlight holder and locator to a wall surface, and means for retaining said flashlight between said engagement arms.

9. The combination flashlight holder and locator set forth in claim 8 wherein said means for resiliently retaining the flashlight between said retaining arms comprises, elongated lugs formed on ends of said arms, said lugs defining tapered engagement surfaces, an elongated concave surface portion on said surface of said main body member.

10. The combination of a flashlight and flashlight holder and locator set forth in claim 8 wherein said means for securing said flashlight holder and locator for a flashlight to a wall surface comprises, longitudinally spaced mounting apertures in said main body member.

11. The combination of a flashlight holder and locator set forth in claim 8 wherein said main body member's upper and lower ends are arcuate and an extension orientation flange extends from said upper arcuate end thereof.

12. The combination of a flashlight holder and locator set forth in claim 8 wherein said luminescent disk is of a synthetic resin material of enhanced illumination retainment properties.

* * * * *